US008943949B2

(12) United States Patent
Thoms et al.

(10) Patent No.: US 8,943,949 B2
(45) Date of Patent: Feb. 3, 2015

(54) NEUTRAL SETTING APPARATUS OF AN ADJUSTABLE HYDRAULIC MACHINE

(75) Inventors: Reinhardt Thoms, Holzbunge (DE); Peter Bahna, Pruzina (SK); Sebastian Bujna, Dubnica nad Vahom (SK); Peter Chlebana, Nova Dubnica (SK); Miroslav Chmatil, Nova Dubnica (SK); Michael Knazek, Nemsova (SK)

(73) Assignee: Sauer-Danfoss Inc., Ames, IA (US)

( * ) Notice: Subject to any disclaimer, the term of this patent is extended or adjusted under 35 U.S.C. 154(b) by 443 days.

(21) Appl. No.: 13/468,596

(22) Filed: May 10, 2012

(65) Prior Publication Data

US 2013/0174723 A1 Jul. 11, 2013

(30) Foreign Application Priority Data

Jan. 9, 2012 (DE) ..... 10 2012 200 217

(51) Int. Cl.
*F01B 3/10* (2006.01)

(52) U.S. Cl.
USPC ..... 91/505; 92/12.2

(58) Field of Classification Search
USPC ..... 91/504, 505, 506; 92/12.2
See application file for complete search history.

(56) References Cited

U.S. PATENT DOCUMENTS

| | | | | |
|---|---|---|---|---|
| 3,429,225 | A * | 2/1969 | Keyworth | 91/506 |
| 5,226,349 | A * | 7/1993 | Alme et al. | 91/506 |
| 6,158,969 | A * | 12/2000 | Graf et al. | 91/506 |
| 7,121,188 | B2 * | 10/2006 | Thoms et al. | 91/506 |
| 7,299,738 | B2 * | 11/2007 | Thoms et al. | 91/506 |
| 8,074,558 | B2 * | 12/2011 | Knussman et al. | 92/12.2 |

* cited by examiner

*Primary Examiner* — Michael Leslie
(74) *Attorney, Agent, or Firm* — Zarley Law Firm, P.L.C.

(57) ABSTRACT

The invention relates to a neutral setting apparatus for adjustable hydraulic machines, in particular the adjustment of the neutral position of a servo valve. In particular, the invention relates to servo adjustment devices with mechanically adjustable control pistons, wherein the forces necessary for this can be applied mechanically, electro-magnetically, pneumatically or hydraulically. The invention relates to a neutral setting apparatus of an adjustable hydraulic machine, with a housing in which a mounted input shaft is arranged, to one end of which a torque can be applied for rotating the input shaft about an axis. Thus providing a robust and cost-effective setting mechanism for the neutral position of a servo valve.

10 Claims, 5 Drawing Sheets

NEUTRAL SETTING APPARATUS OF AN ADJUSTABLE HYDRAULIC MACHINE

BACKGROUND OF THE INVENTION

The invention relates to a neutral setting apparatus for adjustable hydraulic machines, in particular the adjustment of the neutral position of a servo valve. The invention relates in particular to hydrostatic adjustment devices of hydraulic machines, in which both the volumetric delivery and the delivery direction can be set. The invention relates specifically to a servo valve with a control piston for controlling a servo piston which, in turn, sets the volumetric delivery and the delivery direction of the adjustable hydraulic machine. The present invention relates in particular to servo adjustment devices with mechanically adjustable control pistons, wherein the forces necessary for this can be applied mechanically, electromagnetically, pneumatically or hydraulically.

Hydraulic servo valves of very different design are used for adjusting the volumetric delivery of hydraulic pumps. In this case, a servo valve of this type is used to act upon a servo piston with hydraulic fluid or hydraulic pressure in a controlled manner such that the servo piston adjusts the actual adjustment device of the hydraulic machine, for example the swash plate of an axial piston machine. The invention can be used for servo valves of this type. Examples of further fields of use are the control systems of radial piston machines, the eccentricity of which can be set, or inclined-axle machines, the performance or else delivery direction of which can be changed by deflection of a yoke. The servo pistons which act on the adjustment devices of the hydraulic machines are customarily centred in the zero position thereof via springs, as a result of which, when pressure conditions are equalized, for example at a double-sided servo piston, the delivery flow of the hydraulic machine is zero.

The volumetric delivery of zero corresponds to the shutdown of the machine, i.e. power is neither received nor output by the hydraulic machine. This shutdown of the machine is of importance in terms of safety and therefore has to be exactly predefinable by the servo valve device. Via the control edges thereof, the control piston, which is responsible for the pressures applied to the servo piston, in the control valve controls the respective hydraulic pressures to the servo piston or the servo pistons, and therefore the hydraulic neutral position of the control piston in the control cylinder, i.e. the position of said control piston for the shutdown of the hydraulic machine, necessarily has to be exactly settable.

In practice, however, the diameter and the control edges of the control piston and the diameter and the corresponding control edges of the control cylinder are affected by tolerances during production, and therefore the neutral position of the control piston in the control cylinder generally deviates from the structurally predefined central position or the geometrically centred position. If it is therefore intended to centre the control piston of a servo valve in the control cylinder of the servo valve purely geometrically, an asymmetrical pressurization of a, for example, two-sided servo piston cannot be ruled out. This causes displacement of the servo piston, and the adjustable hydraulic machine would be outside the zero position and a shutdown of the machine would not be achievable. A mechanism for the neutral setting is therefore necessary in order to compensate for the position error, caused by manufacturing tolerances, of the control piston in the control cylinder so that, in the hydraulic neutral position of the control piston, the hydraulic machine enables the zero position of the servo piston and therefore a shutdown of the machine can be achieved.

It is ensured by a neutral setting adjustment that, in the event of an indicated position of the servo system, in which the hydraulic machine does not generate a delivery flow, an activating signal counteracting said state is not generated in the servo valve. Failing this, the position of the control piston in the servo valve does not match the position of the servo piston in the adjustment device for the hydraulic machine. In such a case, a shutdown of the machine can never be achieved, since one of the two pistons is always outside the hydraulic centre. A neutral adjustment for the servo valve therefore has the task of centering the control piston in the servo valve in the control cylinder, in the event of shutdown of the machine, such that suitable control edge overlaps with corresponding control edge intervals do not result in any fluid flows or servo pressures which would bring the servo piston of the adjustable hydraulic machine out of balance counter to the spring forces.

As a rule, mechanically actuated servo valves are controlled via Bowden cables or linkages in order to regulate the volumetric delivery of the adjustable hydraulic machine in both delivery directions. Said mechanical activation is intended to react as identically as possible for both delivery directions. This gives rise to the requirement for a symmetrical, but respectively small, dead band of identical size in both delivery directions, within which the pump does not generate any volumetric delivery. At the same time, the maximum volumetric deliveries of the two delivery directions of the adjustable hydraulic machine are also intended to be achieved with an input signal of identical size. Specifically for mechanical adjustments, this means that the deflection of the control apparatus in one direction is intended to be of precisely the same magnitude as in the other direction, so that the discharge capacity which is generated by the adjustable hydraulic machine or is received by the adjustable hydraulic machine is of identical size for both delivery directions. In particular, movement forwards and backwards or pivoting to the left and right, which is intended to take place with the same power in each case, is conceivable here. In a known embodiment for a mechanical drive of a servo valve by means of, for example, a Bowden cable or a linkage, a torque acts on an input shaft on the servo valve in order to rotate said input shaft in the one or other direction of rotation. For various reasons, in particular for safety reasons and for ease of operation reasons, said input shaft must always automatically endeavour to return into the set neutral position thereof. Specifically, the machine operator expects that, after letting go of the deflected control lever, the latter will automatically pivot back again into the neutral position. This can be achieved, for example, by a permanently acting spring force in the servo valve.

In a known embodiment of a neutral setting mechanism of this type, the input shaft, which can be rotated mechanically in two directions, has a flattened portion on which a guided sliding part loaded by spring force acts. The sliding part has a likewise planar face on the contact face between the flattened portion and the end face of the sliding part, as a result of which, when the input shaft rotates out of the neutral extra-axial force applied by the spring force, which acts on the sliding part, generates a resetting torque on the input shaft. Said resetting torque attempts to move the input shaft back again into the neutral position thereof, in which the two faces, i.e. the flat end face of the sliding part and the flat flattened portion on the input shaft rest evenly or flat on each other. In said flat, sheet-like contact, the spring force acts directly in the direction of the axis of the input shaft, and therefore torque is not generated by the spring force. By means of the sheet-like contact of the sliding part with the flattened portion of the input shaft, the sliding part is displaced away from the axis of the input shaft, specifically always in the same direction counter to the spring, irrespective of the direction of rotation of the shaft. As a result, a torque acting in each case in the one or other direction is generated when the input shaft is deflected. If the deflecting torque at the input shaft is smaller than the torque which is generated by the displaced sliding part via the flattened portion on the input shaft, the input shaft automatically rotates back into the neutral position thereof. For the setting/adjustment of the neutral position of the servo valve, the known embodiment proposes displacing the connecting lever, which connects the input shaft to the control piston, relative to the position feedback device via an eccentric. The control piston in the control cylinder therefore adopts a neutral position for the servo adjustment, irrespective of the position of the input shaft. The signal which is passed on by the position feedback means regarding the position of the adjustment device of the hydraulic machine is thus matched to the position of the control piston.

However, since the neutral position of the servo piston in the servo cylinder does not correspond in most situations to the geometrical centre, the deflectability of the control piston in one direction is therefore smaller than the deflectability of the control piston in the other direction, which leads to different volumetric deliveries in the two delivery directions. In the end result, this leads to an asymmetrically adjustable hydraulic machine. The greater the position error to be corrected between the servo valve, i.e. the control piston in the control cylinder, and the involved levers and the involved guides, the greater is the asymmetry between the input signal and the delivery flows in the two delivery directions. Therefore, in this case, different flow rates occur in the one or other delivery direction, since the maximum volumetric deliveries of the hydraulic fluid which can be achieved in the one delivery direction or in the other delivery direction differ.

The invention is therefore based on the object of providing an apparatus for the neutral setting of servo valves for adjustable hydraulic machines, which apparatus ensures the neutral position of the control apparatus when a machine is at a standstill and, furthermore, guarantees symmetry of the volumetric deliveries in both delivery directions. Furthermore, it is an object of the invention to specify a setting mechanism for the neutral position of a servo valve, the setting mechanism managing with just a few components and the construction thereof being simple, robust and cost-effective.

The object according to the invention is achieved with a neutral setting apparatus according to Claim 1, wherein preferred embodiments are specified in the claims dependent on Claim 1.

SUMMARY OF THE INVENTION

In order to obtain the symmetry of the servo valve in respect of a possible dead band and the maximum volumetric delivery irrespective of the neutral setting, the input shaft, the sliding part and the control piston have to be jointly and simultaneously oriented to the neutral setting, thus resulting in the necessary control edge overlaps and the corresponding control edge intervals between the control piston and control cylinder so that an identically sized deflectability of the input shaft to both sides is maintained.

According to the invention, this is achieved by a neutral setting apparatus of an adjustable hydraulic machine with a housing in which an input shaft is rotatably mounted, to which, at a first end, a torque can be applied for rotating the shaft about the central axis thereof. The torque can be applied, for example, via an operating lever. The shaft is preferably arranged at a first end outside the housing, wherein the second end of said shaft projects into the servo housing. At the second end projecting into the servo valve housing, a cylindrical extension is arranged eccentrically with respect to the centre axis and parallel to the latter, said extension being able to move on a circular trajectory with the input shaft. Furthermore, an adjustable control piston is arranged in the servo valve housing, the control edges of which control piston, in interaction with the control edges of a control cylinder, control the fluid passages to a servo piston which, in turn, sets the hydraulic machine with regard to the delivery direction and/or volumetric delivery thereof. For the transmission of the deflections of the input shaft to the control piston, there is a lever which is connected at one end in an articulated manner to the control piston and, at the second end thereof, is mounted in an articulated manner on a position feedback device which transmits the position of the servo piston to the lever. Said position is then transmitted further by the lever to the control piston. A bearing point for receiving the cylindrical extension of the shaft is provided between the two ends of the lever and can be used by the lever to transmit the deflection of the input shaft to the control piston.

Therefore, upon deflection of the input shaft, the cylindrical extension is moved on a circular trajectory, as a result of which the lever, which is fitted in an articulated manner, in particular in a rotatable manner, at the bearing point, is likewise moved in the manner of a circular trajectory, which displaces the control piston in the control cylinder in the servo valve housing. By means of the displacement of the control piston in the control cylinder, the passages for hydraulic fluid for activating the servo piston are changed, and therefore the position of the servo piston is deflected and the hydraulic machine is adjusted. With the eccentric arrangement of the cylindrical extension on the shaft, a rotatory deflecting movement on the input shaft is therefore converted into a displacement movement of the control piston, with which displacement movement the adjustable hydraulic machine can be controlled.

A sliding part which is held elastically in a guide element and can move perpendicularly to the axis of the input shaft is furthermore arranged in the servo valve housing. The sliding part is mounted elastically in the direction of movement and, at one end, has a level, flat end face with which the sliding part can be supported against a level flattened portion on the input shaft. In this case, the support has been prestressed by the elastic mounting. The interaction of the flat/level end face of the sliding part with the level flattened portion formed on the input shaft acts here in the same manner as is known from the exemplary embodiment, described at the beginning, from the prior art.

The guide element receives the other end of the sliding part and provides guidance for the sliding part perpendicularly to the axis of the input shaft. Along said direction of movement, the sliding part can be pressed away from the shaft counter to an elastic force or moved towards the shaft by said elastic force. If the shaft is rotated, the flattened portion of the shaft presses the sliding part, for example, into the guide element counter to the spring force, as a result of which an eccentric contact of the sliding part with the input shaft caused by the rotation of the input shaft generates a torque counter to the direction of rotation of the shaft by means of the elastic force. If the deflecting torque is removed from the shaft, the resetting torque, which is transmitted to the shaft via the sliding part, causes said shaft to return into the neutral position thereof, in which the two level faces rest flat on each other.

According to the invention, the guide element for the sliding part can be rotated in the circumferential direction of the shaft, as a result of which the neutral position of the servo valve can be adjusted. If the guide element is moved in the circumferential direction of the input shaft, the end face of the sliding part loses the planar contact thereof with the flattened portion on the shaft, as a result of which, owing to the elastic force, a torque acts on the shaft via the sliding part, and the shaft follows the movement of the guide element. At the same time as this rotation of the input shaft, the cylindrical stud arranged eccentrically on the shaft is also moved in the manner of a circular trajectory, as a result of which, in turn, the control piston in the control cylinder is adjusted. A neutral position adjustment of the control piston can therefore be undertaken, wherein a relative displacement of the control piston in relation to the deflection of the input shaft is avoided. The symmetry for the deflection in both delivery directions is therefore maintained, as a result of which the delivery maxima in both delivery directions also remain approximately the same. The effect achieved with this arrangement is that the control piston can be adjusted in the neutral position which is important for the safety of the machine and in which the adjustable hydraulic machine does not exhibit any volumetric delivery, i.e. is at a standstill. At the same time, the automatically acting control signal feedback system, which is formed by the two level faces of the sliding part and the flattened portion on the input shaft, is in the geometrical zero position thereof, in which a torque is not exerted on the input shaft. From said geometrical zero position, the input shaft can now be deflected symmetrically to an equal distance in both directions, thus resulting in identically sized maxima in the volumetric delivery at the hydraulic machine for both delivery directions.

By means of the relative rotatability of the guide element and therefore of the sliding part guided therein, a common zero position adjustment, i.e. neutral position adjustment, for the servo valve is achieved, in which the input shaft, the sliding part and the control piston are jointly and simultaneously aligned. This gives rise, between the control piston and servo valve housing, i.e. control cylinder, to the control edge overlap, which is necessary for the shutdown of the machine, on both sides of the control piston and to corresponding control edge intervals which ensure that the servo piston is acted upon symmetrically with hydraulic pressure so that the servo piston does not change the zero position of the adjustable hydraulic machine. It is routinely possible here to operate both with a negative and with a positive control edge overlap, as long as it is ensured that, when the shutdown of the machine is required, the servo piston, which can be acted upon as a rule on two sides with hydraulic pressure, is not displaced out of the zero position thereof and is acted upon on both sides with forces of identical size. The invention therefore uses simple and cost-effective means to provide a robust neutral-position setting apparatus which is also extremely robust.

The effect which is achieved by the independent rotatability of the guide element relative to the input shaft is that, upon the neutral position adjustment of the control piston in the servo valve, the input shaft can be matched at the same time to the adjusted neutral position, and therefore a symmetrical deflection of the input shaft continues to be possible. Said neutral position adjustment of the control piston in the servo valve, which adjustment is preferably carried out during a shutdown of the machine, takes place by the level end face of the sliding part lifting off from the sheet-like recess on the input shaft by rotation of the guide element and thus forcing the input shaft to rotate about the centre axis thereof, as a result of which the lever, which is moved via the cylindrical pin on the shaft, adjusts the control piston. After the end of the adjusting operation, i.e. after the resetting of the zero position, the input shaft is automatically carried along without asymmetries occurring in the servo valve.

In a preferred embodiment, a setting screw which is arranged perpendicularly to the axis of the input shaft and perpendicularly to the direction of movement of the sliding part in the servo valve acts on the guide element, as a result of which, by rotation of the setting screw via, for example, a threaded engagement between the guide element and setting screw, the guide element can be rotated in the circumferential direction of the input shaft. A more or less sensitive adjustment can be achieved depending on the choice of the thread in the setting screw and in the guide element, wherein, the finer the thread, the more precisely the adjustment can take place.

In a further preferred embodiment, that end of the setting screw which is in contact with the guide element has a spherical extension or is of ball-like or convex design, and engages in a corresponding depression on an end side of the guide element. Such a depression may likewise be of spherical design or else may be introduced into the guide element in the form of a trapezoidal groove or key groove. The groove profile is then preferably arranged parallel to the axis of the input shaft. Consequently, the thread for the screwing in or unscrewing of the setting screw is then preferably formed in the servo valve housing through which the setting screw passes. In this case, the screw head of the setting screw is accessible from outside the servo valve housing. This likewise applies to the embodiment mentioned previously.

For both embodiments mentioned previously, the setting screw is preferably supported on an inner wall of the servo valve housing, as a result of which the guide element is supported in relation to the servo valve housing. By means of the elastic prestressing between the guide element and sliding part, a counter force of identical size acts on the setting screw and presses the latter onto the inner wall of the servo valve housing. In order to guide the setting mechanism, consisting of setting screw, guide element, sliding part and elastic element, in the direction of the axis of the input shaft, a groove or a thread, in which the setting element is guided in the axial direction thereof, is preferably arranged on the inner wall against which the setting screw bears.

Such a notch, groove or thread on the inner wall face of the servo valve housing only has to be designed to be of a length such that the empirically determined production tolerances can be compensated for by the adjustment range/pivoting range of the guide element, which range arises from the adjustment range of the setting screw. As a rule, a few degrees of angle in the clockwise direction and anticlockwise with respect to the axis of the input shaft appear to be sufficient here as a customary pivoting range for the guide element.

As described above, the neutral position setting for the control piston in the servo valve can be undertaken by movement of the lever via the cylindrical extension on the input shaft by means of rotation of the input shaft, wherein the lever is supported on the position feedback device which therefore forms a counter bearing therefor. Starting from the zero position of the servo position, i.e. from the shutdown of the machine, in which the hydraulic machine does not exhibit any volumetric delivery, asymmetries due to the production tolerances in the entire adjustment system of the hydraulic machine—servo piston, servo adjustment device, servo valve and the components thereof—can be corrected by rotation of the guide element in the servo valve via a setting screw to the effect that the inflows to and outflow from the servo adjustment of the hydraulic machine are symmetrical and therefore the machine can be kept shutdown. If the hydraulic flows flowing through the passages between the control piston and control cylinder in the servo valve are not of an identical magnitude for the respective delivery direction, an adjustment would take place in the servo adjustment device, as a result of which the hydraulic machine would be deflected out of the zero position thereof. The present invention advantageously makes it possible to avoid this and to maintain the symmetry of the servo valve.

In the adjusted neutral position of the servo valve, as explained above, the passages for pressurizing a servo adjustment device of a hydraulic machine are symmetrical, i.e. the same quantity of hydraulic fluid flows through the respective inflows and outflows for both delivery directions of the hydraulic machine. In this case, a positive control edge overlap is also included, in which a hydraulic flow does not flow on either of the two sides. A reliable zero position of the servo piston during the servo adjustment of the hydraulic machine can therefore be reached and, in turn, can be reliably maintained during the shutdown of the machine. The described embodiment ensures that, in the neutral position, the movement device of the sliding part, which frequently also constitutes the common axis of the guide element and sliding part—when the latter are designed, for example, as rotationally symmetrical bodies—always has an intersecting point with the axis, which runs at right angles thereto, of the input shaft. In this case, the level faces of the end face of the sliding part and that of the flattened portion, which is formed, for example, in a recess on the input shaft, lie flat on each other. In a further preferred arrangement of the elements in the servo valve, the axis of the position feedback device is likewise perpendicular to the common axis of the guide element and of the sliding part. Depending on the position of the guide element in the circumferential direction of the input shaft, an intersecting point is produced here in the specific case between the axis of the lever of the position feedback device and the common axis of the guide element and sliding part. In a theoretical arrangement of the individual elements of the servo valve, i.e., for example, in the theoretical design and development of a servo valve, said intersecting point of the position feedback device together with the axis of the guide element and sliding part could define the theoretical zero point of the servo valve. From said zero point, the guide element can be adjusted in the clockwise direction or anticlockwise in order, in practice, to compensate for the manufacturing tolerances of the individual parts and ultimately to displace or rotate the control piston into a position in which the inflows and outflows are formed symmetrically on both sides of the control piston. The position feedback device of an adjustable hydraulic machine customarily consists of a lever which is connected to the adjustment device of a hydraulic machine, for example a swash plate of a swash plate axial piston pump or, for example, to the inclined axle of an inclined-axle hydraulic motor, and is carried along with the respective deflection. The position feedback device customarily has a pin which projects into the servo valve and is mounted there in an articulated manner such that said pin represents the position of the adjustment element of the hydraulic machine in the servo valve depending in each case on the position of the deflected hydraulic machine. At the same time as the movement of the lever of the position feedback system, the lever of the servo valve is moved in order to adjust the control piston, which, in turn, has an effect on the position of the control piston in the servo valve. In this case, the cylindrical extension on the input shaft, which extension is arranged eccentrically with respect to the centre axis of the input shaft, forms the hub for the lever of the servo valve. If the input shaft of the servo valve is rotated, the position of the hub, i.e. the rotational mounting of the lever of the servo valve, also changes, as a result of which the position of the control piston is changed. Such a change in position of the control piston results in a change in the passages to the servo piston, as a result of which the position of the hydraulic machine is changed.

In the case of adjustable hydraulic machines, the adjustment range is generally limited because of structural specifications or because of the optimum operating points sought, and therefore a stroke limitation of the control piston should also be provided for the servo valve. In the case of the servo valve according to the invention, this can take place, for example, by means of a stroke limitation, i.e. a limitation of the movement between the guide element and sliding part by means of a stop. If, therefore, because of the stop, the sliding part cannot be pressed further into the guide element, the input shaft cannot be rotated further either. This can be sensed by the machine operator as a mechanical stop. Other configurations of a rotational stop in a conventional manner with, for example, a stud on the input shaft and a stop in the servo valve housing are likewise conceivable here.

In a further preferred embodiment, the sliding part at the same time takes on axial guidance of the input shaft by said sliding part engaging in a groove in the input shaft, wherein the faces which are adjacent to the level end face and are preferably oriented perpendicularly to the axis of the input shaft fix the input shaft in terms of the axial movability thereof. If the input shaft is not fixed in the axial direction, the input shaft may be pressed out of the servo valve housing by the hydraulic pressure which is present in said servo valve housing. In order to prevent this, in the prior art the input shaft is fixed, for example, via a cover which is arranged outside the servo valve housing. According to the invention, the input shaft can be secured axially via the sliding part or else via the guide element which then, for example, engages around the input shaft in a circumferential groove. For this purpose, fork-like extensions are preferably formed on the guide element, said extensions engaging in a circumferential groove of the input shaft. Care should be taken here to ensure that the fork-like extensions and the circumferential groove of the input shaft do not obstruct the rotatability of the input shaft. A prerequisite for both preferred embodiments for axially fixing the input shaft is that the guide element and the sliding part are likewise fixed axially in the servo valve housing, i.e. in the direction of the axis of the input shaft, or can be supported against the servo valve housing. For this purpose, for example, a suitably configured shoulder can be formed in the servo valve housing. The setting screw may also be considered to be a further support in the axial direction, wherein high forces cannot be transmitted here. In order to prevent the input shaft from being pressed into the servo valve housing, a shaft shoulder can be provided at the first end of the input shaft, the shaft shoulder preventing displacement of the input shaft into the servo valve housing.

In a further preferred embodiment, the fork ends of the guide element not only project into a circumferential groove on the input shaft but are of such wide design perpendicularly to the axis of the input shaft that they can likewise engage in a groove which is arranged in circumferential groove of the input shaft. The fork like extensions of the guide element therefore engage the servo valve housing level with the both in the groove in the input shaft and in a groove in the servo valve housing and therefore serve as a type of shaft securing ring to prevent the input shaft from being able to move in the axial direction either out of the valve housing or into the servo valve housing. Fork ends configured in this manner on the guide element then render a shaft shoulder provided outside the servo valve housing, as described in the previous exemplary embodiment, superfluous. Fork-like extensions which engage at the same time in a groove in the input shaft and in a groove in the servo valve housing secure the input shaft in the position thereof such that said input shaft only still has one degree of freedom, that of the rotation about the centre axis thereof.

If the guide element is designed as previously described, i.e. it engages around the shaft in a circumferential groove of the shaft and at the same time engages in a groove or recesses in the servo valve housing, the axial securing task of the sliding part can likewise be dispensed with, thus reducing frictional forces which arise due to the end of the sliding part with the planar end face sliding into or out from the recess on the input shaft. Therefore, the purely radial direction of movement remains for the sliding part in order to fix the neutral position of the servo valve. With the engagement of extensions of the guide element in the servo valve housing, the guide element can simultaneously be fixed in the axial position thereof with regard to the servo valve housing, as a result of which axial forces, i.e. forces in the direction of the input shaft, are avoided. If the setting screw is configured with a spherical end within the servo valve housing, and if in the servo valve housing on the inner wall, against which the spherical end of the setting screw bears, and at the same time that end of the guide element in which the spherical end of the setting screw engages is of ballike configuration or is optimized in terms of friction, excessive spot-type press-on forces can be avoided, which results in easy adjustability of the servo valve.

For an improvement in the feel with regard to the Zero position, i.e. neutral position of the servo valve, it is possible, for example, for a resiliently mounted ball to be provided on a surface, which is adjacent to the input shaft in the axial direction, of the end face of the sliding part, said ball latching into a corresponding notch in an axial face of the input shaft in the neutral position of the servo valve. This principle may, of course, also be reversed, such that the notch is arranged in the sliding part and a resiliently mounted ball is provided in the input shaft on an axial face. However, a ball formation may also be provided on the end face of the sliding part itself, wherein a spherically designed region on the end face of the sliding part engages in a corresponding recess of the input shaft as soon as the two planar surfaces lie level on each other.

The present invention creates a simple, robust and cost-effective option of providing a servo valve for the adjustment of a hydraulic machine, the neutral position of which servo valve can be set, and wherein the symmetry of the adjustment range of the servo valve is maintained. A number of exemplary embodiments are illustrated by way of example below with reference to drawings, but said exemplary embodiments are not intended to limit the scope of protection of the present invention.

DETAILED DESCRIPTION OF THE PREFERRED EMBODIMENTS

Figure 1:
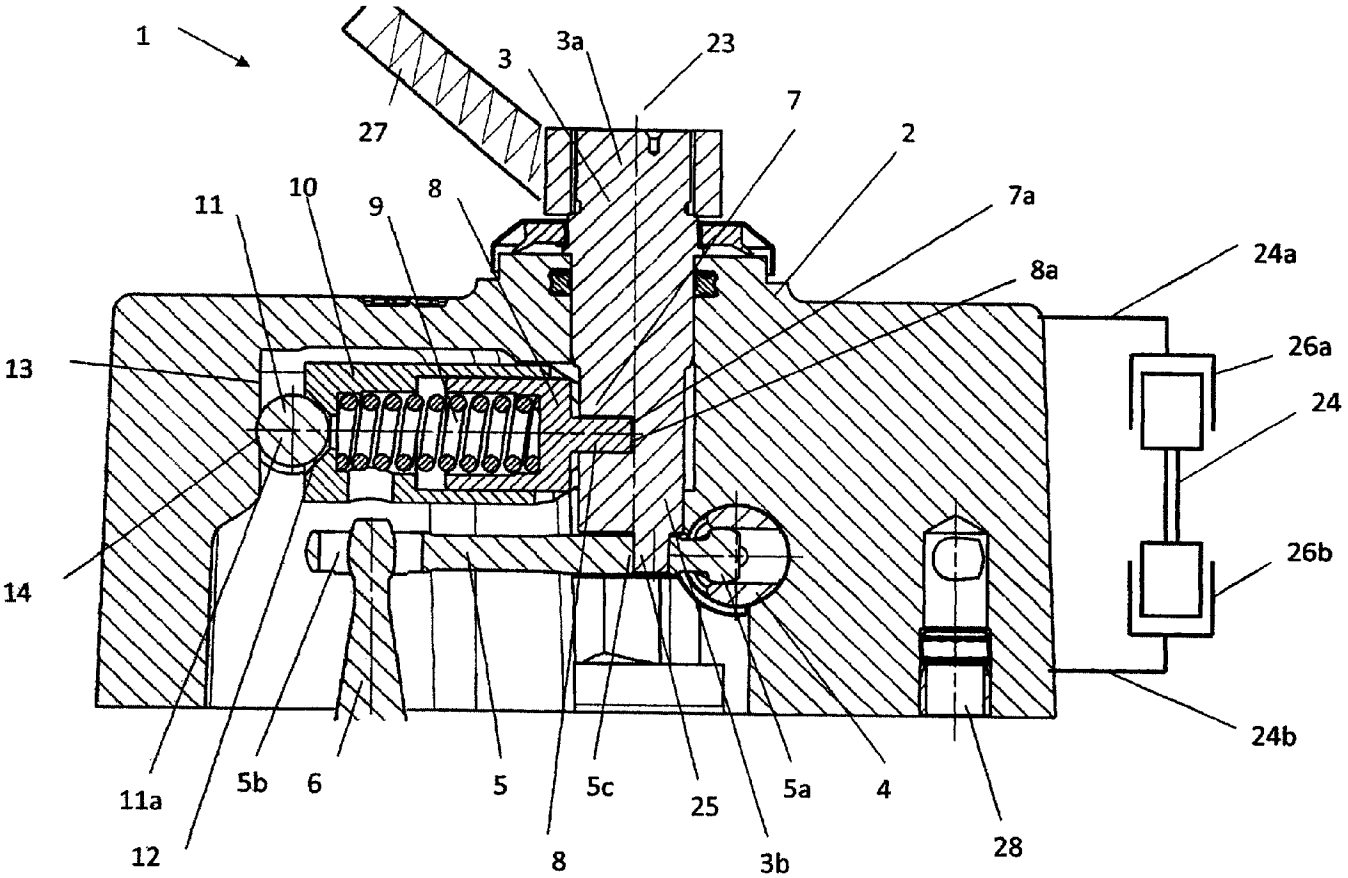
FIG. 1 shows a partially schematic illustration of the adjustable hydraulic machine with a neutral setting apparatus according to the invention.

FIG. 1 shows a section in lateral view through a servo valve 1 with a neutral setting apparatus according to the invention with a servo valve housing 2 in which an input shaft 3 is rotatably mounted. The input shaft 3 is connected at the upper end 3*a* thereof to an operating lever 27 and can be pivoted via the latter in an angular range about the axis 23 by an operator. A cylindrical extension 25 is formed at the lower end 3*b* of the input shaft 3, said extension being arranged eccentrically with respect to the axis 23, but parallel thereto. The extension 25 engages in a recess, serving as a bearing point 5*c*, in a lever 5, the first end 5*a* of which is mounted in an articulated manner in the control piston 4 of the servo valve 1 and is guided pivotably within a limited angular range. The second end 5*b* of the lever 5 is connected to a lever 6 of a position feedback device.

As indicated schematically in FIG. 1, the servo valve 1 is connected via pressure lines 24*a*, 24*b* to pressure cylinders 26*a*, 26*b* which act on a servo piston 24 of an adjustment device of a hydraulic machine (not shown). The position of the first end 5*a* of the lever 5 determines the position of the control piston and therefore the pressure conditions prevailing in the pressure lines 24*a*, 24*b* and therefore the position of the servo piston 24 which brings about the actual adjustment of the hydraulic machine. The servo valve 1 and the pressure lines 24*a*, 24*b* are supplied with hydraulic fluid, customarily hydraulic oil, via connections 28 on the servo valve 1, of which only one connection 28 is shown by way of example in FIG. 1.

The lower region of the input shaft 3 has a groove-like recess 7, the bottom face of which is designed as a level flattened portion 7*a*. One end of a sliding part 8, which end has a level end face 8*a*, is guided in a sliding manner in the recess 7. The end of the sliding part 8 is dimensioned in such a manner that the end face 8*a* can enter into form-fitting contact with the flattened portion 7*a* of the input shaft 3, wherein said contact can extend as far as the complete, parallel contact of the two level faces 7*a* and 8*a*. According to this exemplary embodiment, the other end, here of cylindrical design, of the sliding part 8 is mounted in a sliding manner in the interior of a guide element 10 and is prestressed in relation to said guide element 10 via the spring 9 in the direction of the axis 23 of the input shaft 3. An internal taper 12 which is in contact with a, for example, convex or ball-like end 11*a* of the setting screw 11 is formed on an outer end face of the guide element 10. Said end 11*a* is also supported on a groove 14 on an inner wall face 13 of the servo valve housing 2.

Figure 2:
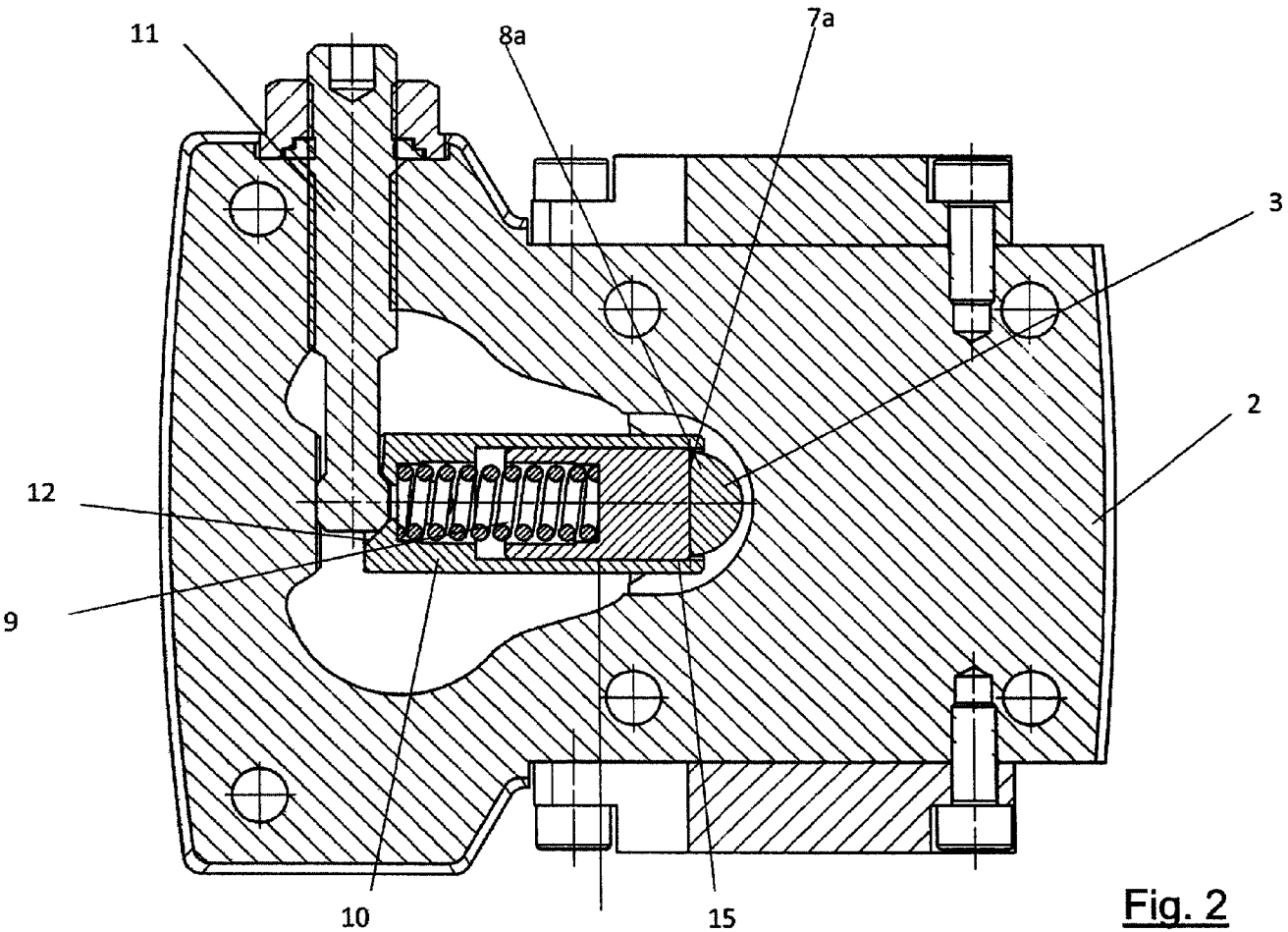
FIG. 2 shows a section through a servo valve according to the first exemplary embodiment.

FIG. 2 shows a further section in the top view through the servo valve 1 according to FIG. 1 level with the axis of the setting screw 11. The input shaft 3 is located in the centre of the servo valve housing 2, said input shaft being sectioned here level with the recess 7 and therefore having a crescent-shaped appearance with the flattened portion 7*a*. The flattened portion 7*a* is in full, sheet-like contact with the level end face 8*a* of the sliding part 8, which corresponds to the neutral position of the adjustment device. Parts of the guide element 10 that are shaped in the manner of a fork end 15 engage around the input shaft 3 and are thereby supported in relation to the latter. This end of the guide element 10 is therefore fixed laterally, the fixing nevertheless permitting pivoting about the axis 23 of the input shaft 3. A spring 9 is shown in the interior of the guide element 10, the spring being designed as a compression spring and pressing the sliding part 8 against the input shaft 3. The setting screw 11 is mounted in a longitudinally displaceable manner in the housing 2 via a thread and engages with the convexly formed end 11*a* thereof in the depression of the internal taper 12 on the end side of the guide 10. The opposite side of the convex end 11*a* of the setting screw 11 is supported in the groove 14 in the servo valve housing 2, and therefore the guide element 10 with the spring 9 and the sliding part 8 is supported at both ends and the spring 9 can exert pressure on the input shaft 3.

The neutral position of the operating device 27 of the hydraulic machine is set via the setting screw 11 in the following manner: an adjustment of the setting screw 11, the end region of which, projecting out of the servo valve housing 2, is shaped for the engagement of an adjustment tool, results in the guide element 10 being carried along, since the depression thereof, which is designed as an internal taper 12, is mounted in a form-fitting frictional manner in the end face of the convex end 11*a* of the setting screw 11. This causes pivoting of the sliding part 8, which is mounted in the guide element 10 and has the level end face 8*a*, in relation to the input shaft 3. By this means, the input shaft 3 is likewise pivoted, since the end face 8*a* lifts off from the flattened portion 7*a* and generates a torque on the input shaft 3. The pivoting of the input shaft 3 is transmitted by the cylindrical extension 25 on the lower end 3*b* of the input shaft 3 to the lever 5 for adjustment of the end 5*a* thereof in the control piston 4. By this means, the respective pressure in the pressure lines 24*a*, 24*b* to the pressure cylinders 26*a*, 26*b* can be set sensitively. The pivoting of the input shaft 3 is also shown at the operating lever 27 which is connected to the upper end of the input shaft 3. Said operating lever can be fixed in a desired position by means of a releasable and lockable connection between the input shaft 3 and the operating lever 27 after the neutral setting of the apparatus has taken place. This permits, for example, the adjustment of the operating lever 27 with respect to a scale on a control console of the hydraulic machine after each setting of the neutral position of the control piston 4 of the servo valve 1, and therefore of the servo piston 24, has taken place.

During the operation of the hydraulic machine, the operating lever 27 can be pivoted by the operator from the neutral position, which may be, for example, a central position, in a predetermined direction. The pivoting angle predetermines the desired reaction of the hydraulic machine in a known manner by the control piston 4, which is displaced in consequence, changing the flow of the hydraulic fluid in the pressure lines 24*a*, 24*b*, as a result of which the servo piston 24 (see FIG. 1) is displaced in one or the other direction. The displacement of the servo piston 24 causes a change in the direction and/or in the delivery amount of the hydraulic fluid in the main circuit of the hydraulic machine which is brought as a result to the action desired by the operator.

By means of the pivoting of the input shaft 3, which is caused by the operator via the operating lever 27, the contact between the flattened portion 7*a* and the level end face 8*a* of the sliding part 8 is also changed. Instead of the extensive contact in the neutral position, there is now only linear contact on one side of the two faces 7*a* and 8*a*. Since the force transmitting line of contact lies eccentrically with respect to the axis 23, the sliding part 8 which is pressure-loaded by the spring 9 exerts a torque on the input shaft 3. Said torque has the tendency to counteract the adjustment by the operator and to guide the operating lever back into the neutral position. Said resetting force accordingly has to be overcome constantly by the operator. Release of the operating lever 27 results in automatic return of the operating lever 27, and therefore of the control piston 4, into the neutral position because of the elastically prestressed sliding part 8.

Figure 3:
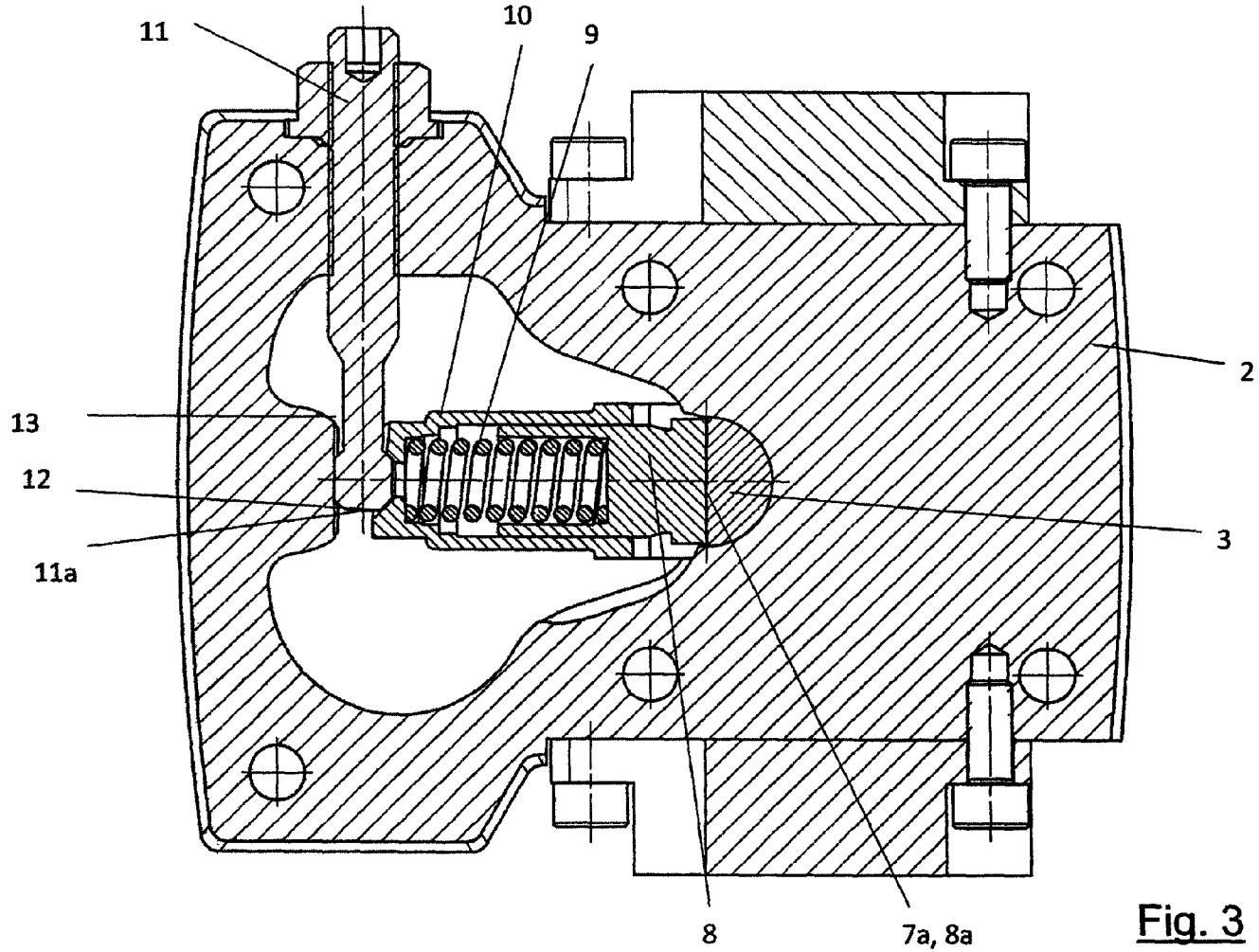
FIG. 3 shows a sectional illustration of a second exemplary embodiment.
Figure 5:
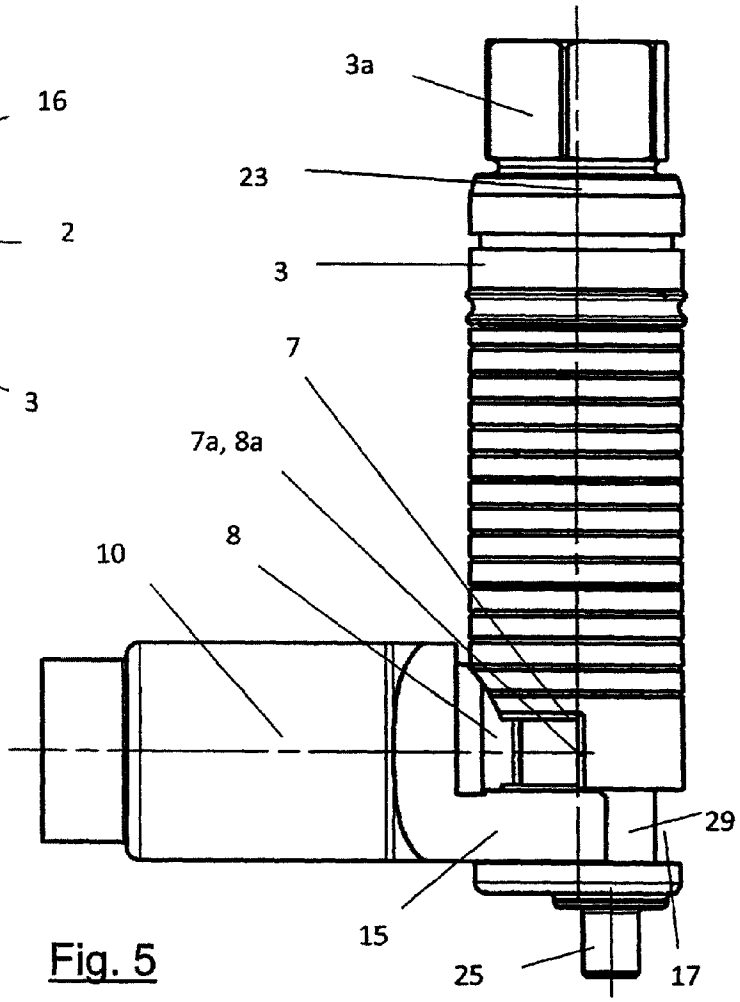
FIG. 5 shows an embodiment according to FIG. 4 in a front view.
Figure 4:
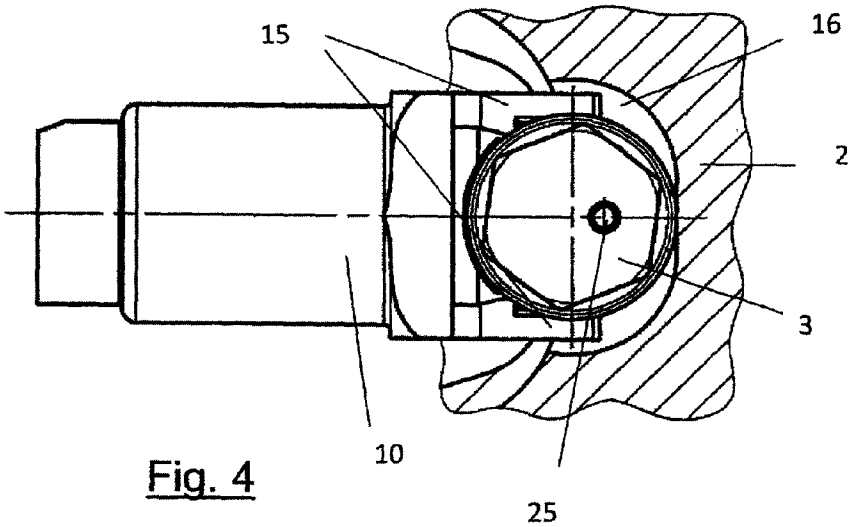
FIG. 4 shows a detailed view of a third embodiment in a partial section.

FIGS. 3 to 5 illustrate further similar examples according to FIG. 2 of the invention, wherein FIG. 3 shows a cross section, FIG. 4 shows a top view and FIG. 5 shows a lateral view of details of the essential components for setting the neutral position. These exemplary embodiments differ from the previously described one by, inter alia, the differing configuration of the guide element 10 and the connection thereof to the input shaft 3. For corresponding parts, use is made in these figures and in the further figures of the same reference numbers as in FIGS. 1 and 2. It can be seen in FIGS. 4 and 5 that that end of the guide element 10 which is adjacent to the input shaft 3 is of fork-shaped design in the lower region and, in order to stabilize the position of said end, it engages around a lower part of the input shaft 3 in a cylindrical region 29 of smaller diameter. The ends of the fork 15 reach beyond an imaginary centre plane of the input shaft 3, and therefore the guide element 10 is guided securely even during the pivoting of the input shaft 3. In addition, the ends of the fork 15 fix the input shaft 3 against an axial displacement out of the servo valve housing 2, which displacement could take place under the action of the fluid pressure in the servo valve housing 2. For this purpose, the ends project at one end into the region 29 of smaller diameter of the input shaft 3 and are supported at the other end in a correspondingly shaped groove 16 (not illustrated) in the servo valve housing 2. In this exemplary embodiment, the sliding part 8 is held in a longitudinally displaceable manner in the cylindrical guide element 10 and is prestressed in the direction of the input shaft 3 by the spring 9.

Figure 6:
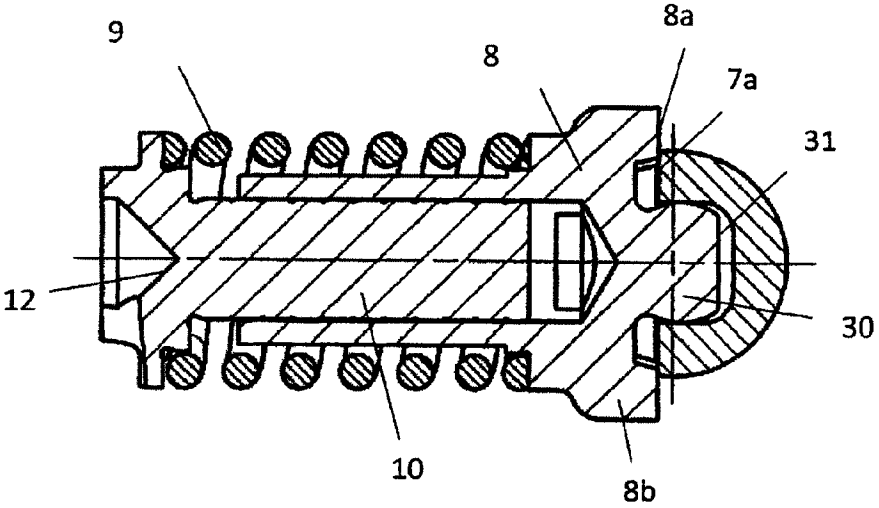
FIG. 6 shows a further exemplary embodiment in the section through the guide element.

FIG. 6 shows a further structural alternative of the invention in plan view of a cross section, in which the guide element 10 for the sliding part 8 is arranged in the interior thereof and the spring 9 is arranged on the outside of said components. The front end of the sliding part 8 with the level end face 8*a* is mounted here in a recess in the form of a groove 16 (not illustrated) of the servo valve housing 2, which groove surrounds a partial region of the input shaft 3. The wall of the groove 16 and the front end region of the sliding part 8 are shaped in such a manner that pivoting is possible, but secure guidance of the sliding part 8 perpendicularly to the axis 23 of the input shaft 3 is always ensured. According to the exemplary embodiment according to FIG. 6, the front end of the sliding part 8 is shaped spherically and penetrates the recess 7 in the input shaft 3. In this case, the walls of the recess 7 stabilize both the axial displacement of the sliding part 8 and also that of the input shaft 3, into the groove-like recess 7 of which the sliding part 8 projects. The rear end of the sliding part 8 has a bore in which the guide element 10 is mounted in a sliding and longitudinally displaceable manner. The guide element 10 and sliding part 8 are braced against each other by the spring 9 which is arranged on the cylindrical outside of the sliding part 8. The rest of the arrangement and the manner of operation thereof correspond to the previously described exemplary embodiments. During rotation of the input shaft 3, the spherically shaped extension 30 of the sliding part 8 remains in engagement with the recess 7, as a result of which the axial fixing of both components is maintained even during pivoting of the input shaft 3.

Figure 7:
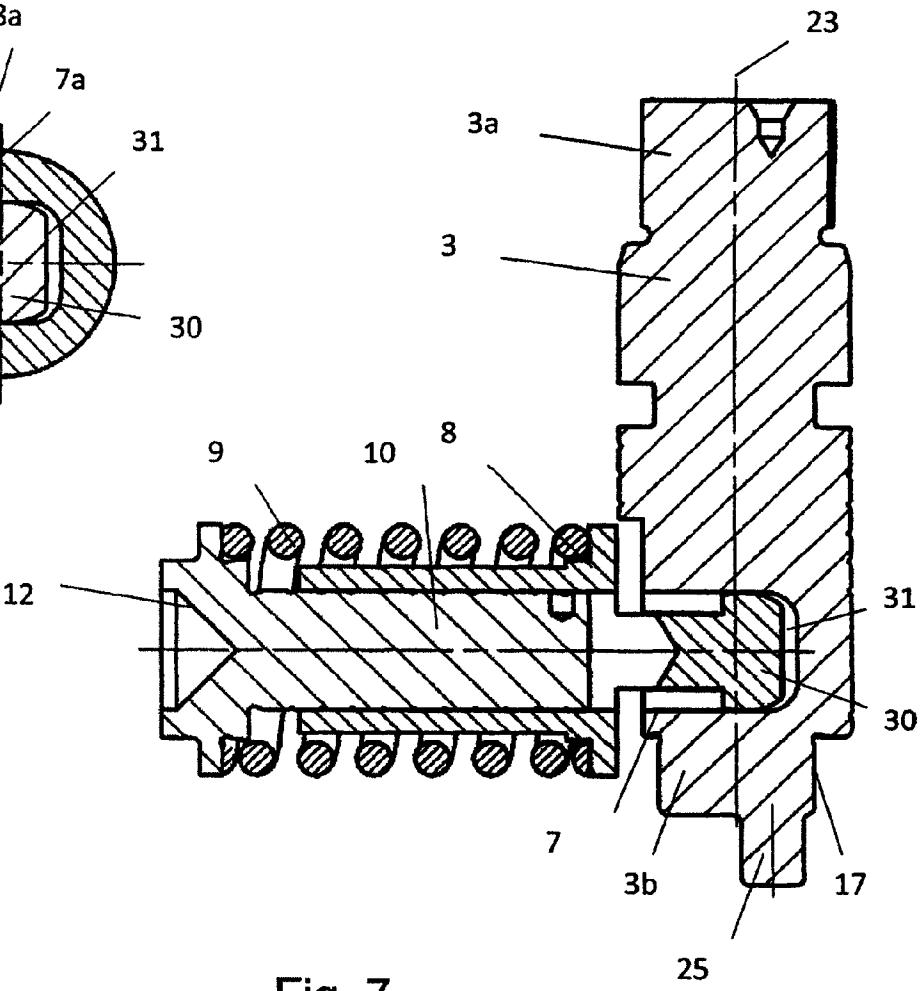
FIG. 7 shows a further exemplary embodiment for the guide element.

FIG. 7 shows a further exemplary embodiment of the invention in section in plan view. A detailed view of the essential components for setting the position of the input shaft 3 is illustrated. A structural alternative of the arrangement according to FIG. 6 is shown. The front side of the sliding part 8 that faces the input shaft 3 has a convex or spherical stud 30 which engages in a recess 31, shaped in a substantially complementary manner thereto, at the bottom of the recess 7 in the input shaft 3. By this means, the front end of the sliding part is mounted and fixed in the input shaft 3. The front region of the sliding part 8, which region surrounds the stud, contains the level end face 8*a* which can be in contact with the input shaft 3 in the circumferential region thereof having the flattened portion 7*a*. This front region 8*b* of the sliding part 8, which region is of a greater width than the other regions, is guided in a groove 14 (not shown 35 here) in the servo valve housing 2. This is analogous to the constructional form described with reference to FIG. 6 and likewise serves to axially secure the relative position of the sliding part 8 and input shaft 3 in the servo valve housing 2.

We claim:

1. Neutral setting apparatus (1) of an adjustable hydraulic machine with a housing (2) in which the following are arranged:

an input shaft (3) which is mounted in the housing (2), with a first end (3*a*) to which a torque can be applied for rotating the input shaft (3) about an axis (23), and a second end (3*b*) on which an extension (25) which is cylindrical eccentrically parallel to the axis (23) is arranged, an adjustable control piston (4) for opening and closing hydraulic fluid passages for pressurizing a servo piston (24) which adjusts the hydraulic machine with regard to the volumetric delivery thereof, a lever (5), with a first end (5*a*) and a second end (5*b*), and with a bearing point (5*c*) which is arranged between the two ends (5*a*, 5*b*) and in which the cylindrical extension (25) of the input shaft (3) engages, wherein the first end (5*a*) of the lever (5) is connected in an articulated manner to the control piston (4), and the second end (5*b*) of the lever (5) is mounted in an articulated manner on a position feedback device (6) which transmits the position of the servo piston (24) to the lever (5), a sliding part (8) which has, at one end, a level end face (8*a*) with which said sliding part is supported against a level flattened portion (7*a*) on the input shaft (3), wherein the sliding part (8) is elastically prestressed perpendicularly to the axis (23) of the input shaft (3) and is held by a guide element (10) in such a manner that the sliding part (8) is movable relative to the guide element (10) perpendicularly to the axis (23) of the input shaft (3) and, in the neutral position of the control piston (4), the level end face (8*a*) and the level flattened portion (7*a*) rest flat on each other, wherein the guide element (10) is supported relative to the housing (2) in such a manner that the guide element (10) is rotatable relative to the input shaft (3) in the circumferential direction thereof.

2. Neutral setting apparatus (1) according to claim 1, in which the guide element (10) is acted upon by a setting screw (11) which is arranged perpendicularly to the direction of movement of the sliding part (8) and perpendicularly to the axis (23) of the input shaft (3) and which, at one end (11*a*), supports the guide element relative to the housing (2) and engages in the guide element (10) in such a manner that the guide element (10) is rotatable relative to the input shaft (3) in the circumferential direction thereof by rotation of the setting screw (11).

3. Neutral setting device (1) according to claim 2, in which that end (11*a*) of the setting screw (11) which is in engagement with the guide element (10) is of spherical design and engages in a corresponding recess (12) on the guide element (10) and is supported in a groove (14) in the housing (2), which groove is formed on an inner wall (13) of the housing (2), the inner wall being parallel to the axis (23).

4. Neutral setting apparatus (1) according to claim 1, in which the guide element (10) has a cup-like bore in which the sliding part (8) is guided and on the bottom face of which an elastic element (9) is supported, said elastic element prestressing the level end face (8*a*) of the sliding part (8) against the level flattened portion (7*a*) on the input shaft (3).

5. Neutral setting apparatus (1) according to claim 1, in which the level flattened portion (7*a*) on the input shaft (3) is formed in a recess (7) of the input shaft (3).

6. Neutral setting apparatus (1) according to claim 5, in which that end of the sliding part (8) on which the end face (8*a*) is formed provides axial guidance of the input shaft (3) together with the recess (7) in the input shaft (3).

7. Neutral setting apparatus (1) according to claim 1, in which the input shaft (3) has a peripheral groove (29) in which the guide element (10) engages by means of fork-like ends (15), as a result of which the guide element (10) is connected to the input shaft (3) in a manner fixed axially.

8. Neutral setting apparatus (1) according to claim 1, in which that end of the sliding part (8) on which the level end face (8*a*) is formed has an elastically mounted ball (30) which, in the neutral position of the control piston, latches into a corresponding recess (31) in the input shaft (3).

9. Neutral setting apparatus (1) according to claim 1, in which the hydraulic machine is integrated in a closed hydraulic circuit.

10. Neutral setting apparatus (1) according to claim 1, in which the input shaft (3) is rotatable mechanically or electromagnetically.

* * * * *